US005163637A

United States Patent [19]

Hansén

[11] Patent Number: 5,163,637

[45] Date of Patent: Nov. 17, 1992

[54] ROLL ANGLE DETERMINATION

[75] Inventor: Ake Hansén, Karlstad, Sweden

[73] Assignee: AB Bofors, Bofors, Sweden

[21] Appl. No.: 687,047

[22] Filed: Apr. 18, 1991

[30] Foreign Application Priority Data

Apr. 18, 1990 [SE] Sweden ..... 9001370-7

[51] Int. Cl.[5] ..... F41G 7/30

[52] U.S. Cl. ..... 244/3.21; 244/3.11; 244/3.14

[58] Field of Search ..... 244/3.11, 3.13, 3.14, 244/3.21

[56] References Cited

U.S. PATENT DOCUMENTS

| | | | |
|---|---|---|---|
| 4,030,686 | 6/1977 | Buchman | 244/3.13 |
| 4,750,689 | 6/1988 | Yff | 244/3.14 |
| 4,967,981 | 11/1990 | Yff | 244/3.21 |
| 4,979,696 | 12/1990 | Yff | 244/3.14 |

FOREIGN PATENT DOCUMENTS

| | | |
|---|---|---|
| 0341772 | 11/1989 | European Pat. Off. . |
| 0345836 | 12/1989 | European Pat. Off. . |

*Primary Examiner*—Charles T. Jordan

*Attorney, Agent, or Firm*—Pollock, Vande Sande & Priddy

[57] ABSTRACT

An apparatus for determining the roll angle position of a rotating projectile, with the aid of polarized electromagnetic radiation, comprises a transmitter for emitting a position-determining polarized radiation in the direction towards the projectile and a receiver arranged in the projectile for receiving the transmitted radiation. The emitted radiation consists of two components, a first component in the long-wave (LF) band and a second component in the microwave band. The microwave component comprises a pulse train in which the pulses are intended to indicate when the long-wave component is situated in a certain phase position, for example, to indicate the sinusoidal long-wave component's zero cross-overs with a positive-going derivative. This takes place in such a way that a synchronizing pulse is emitted by the long-wave transmitter to the microwave transmitter which transmits a short series of microwave pulses as an indication to the projectile.

8 Claims, 2 Drawing Sheets

ROLL ANGLE DETERMINATION

FIELD OF THE INVENTION

The present invention relates to an apparatus for determining the roll position of a rotating projectile, shell, missile or the like with the aid of polarized electromagnetic radiation.

The invention is applicable to all types of projectiles, missiles or the like which are fired from a barrel or launch tube and which rotate in their trajectory. The invention can be used in particular in so-called terminal-stage-guided ammunition, i.e. projectiles which are fired in a conventional manner in a ballistic trajectory to the immediate vicinity of the target, where they receive a command for necessary correction. Due to the fact that the projectile rotates in its trajectory, its roll position must be determined when the command is executed. In the absence of means for determining the roll position, an error otherwise occurs in the course correction.

BACKGROUND ART

It is already known from Swedish Patent Application 8801831-2 to determine the roll angle position with the aid of polarized electromagnetic radiation, comprising a transmitter arranged to emit a polarized radiation in the direction towards the projectile and a polarization sensitive receiver arranged in the projectile. By having the emitted polarized radiation consist of at least two mutually phase-locked radiation components with a wavelength ratio of 2:1 and/or multiples thereof, which are superposed and form an asymmetrical curve shape, the roll position of the projectile can be unambiguously determined.

This prior art requires that a transmitter is placed in connection with the launching position of the projectile and that the projectile is provided with a rearward-directed receiving antenna in order to receive the transmitted radiation.

Furthermore it is necessary that two mutually phase-locked radiation components with different frequencies are transmitted. This means that both the transmitter and the receiver are of a relatively complicated construction.

It is also already known from EP 0,341,772 to determine the roll angle position by giving the one carrier wave a sinusoidal amplitude modulation in order to continuously transmit information on the phase position. As described in this patent such a system has is advantageous due to simpler construction of the receiving part in the projectile. However, two antennae of known relative orientation are required in the receiver.

SUMMARY OF THE INVENTION

The purpose of the present invention is to provide an alternative to the devices described above for roll angle determination, in which, instead of a continuous transmission of the phase position, a transmission of phase information takes place only at certain points in time, for example, when the signal passes through zero with a positive-going derivative.

According to the invention, the transmitter emits on the one hand a polarized sinusoidal radiation in the long-wave band and on the other hand a polarized microwave radiation in the form of a pulse train in which the pulses indicate that the long-wave component is located in a certain phase position, for example, the sinusoidal signal's zero cross-over with a positive-going derivative. The two radiation components are then detected in the shell and are applied to a microprocessor system for evaluation.

The advantage of transmitting the information on the phase position only at certain points in time is that such a system is more interference-proof. The risk of detection is less, since it is more difficult to calculate, from the short pulses, the frequency which is being used for the transmission and therefore to disrupt the transmission.

It suffices to transmit the information on a single occasion when the shell is at the start of its trajectory. If the processor of the receiver has received the information only once, it can then keep track of the roll position of the shell by counting dips in the envelope of the received signal.

Alternatively, the information on the phase position can be transmitted exactly at the time when correction of the trajectory is to be carried out.

In order to improve the interference security through redundancy, the information can preferably be repeated on a number of occasions during the passage of the shell in the trajectory.

A further advantage of the invention is that only one antenna needs to be used in the long-wave receiver for the detection. This of course represents a simplification, and both an antenna and an amplifier can be omitted in the long-wave receiver.

BRIEF DESCRIPTION OF THE DRAWINGS

One embodiment of the present invention is shown diagrammatically in the attached drawings, in which.

DETAILED DESCRIPTION OF THE DRAWINGS

Figure 1:
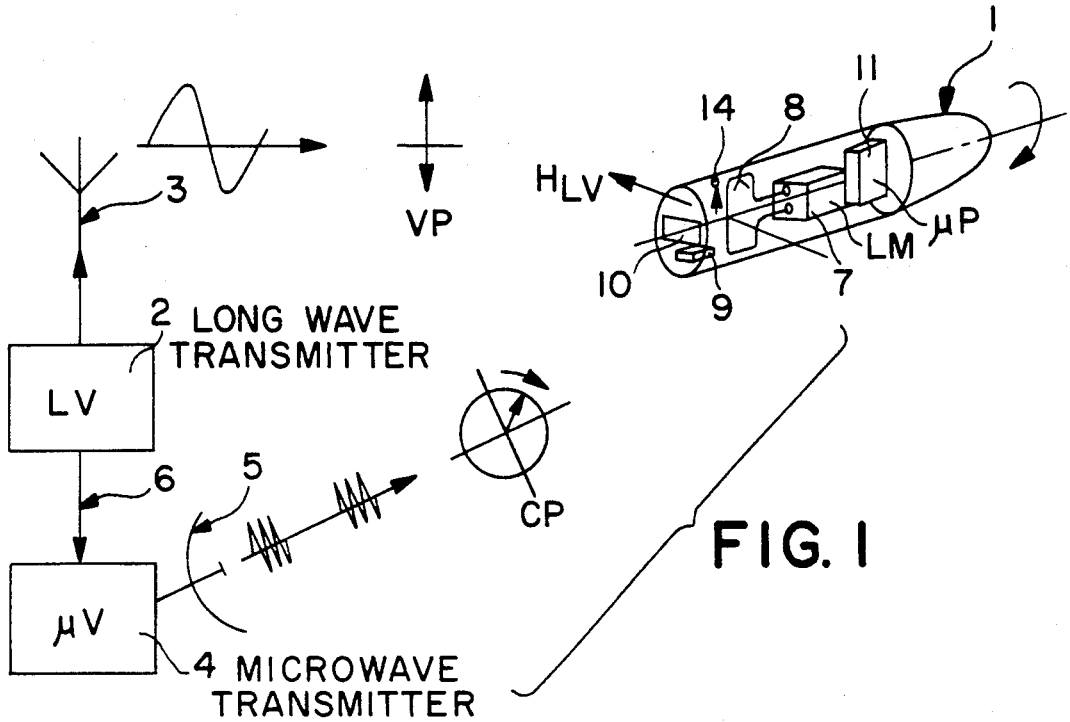
FIG. 1 is a view of the projectile and the equipment required for determining the roll angle position of the projectile.

In order to give a projectile, shell or the like an improved stability in its trajectory, it is already known to give it a rotation upon firing. Built-in electronics in the shell intended for tactical purposes in this case lose the references to the roll position angle. FIG. 1 shows an outline diagram of how a roll angle reference can be unambiguously determined.

A transmitter is positioned on the gun or in its immediate vicinity, which transmitter comprises two sets of transmission equipment, one for the long-wave band and one for the microwave band, both transmitting polarized electromagnetic radiation towards the shell 1.

The long-wave transmitter 2 transmits via an antenna 3 a vertically polarized (VP), sinusoidal radiowave in the long-wave band (LF) and a microwave transmitter 4 transmits via the antenna 5 a directed circularly polarized wave (CP) towards the shell 1 on the microwave band ( V). The transmitter 2 sends synchronizing codes to the transmitter 4 via connection 6.

The long-wave band (LF) comprises the frequency range of 30–300 kHz and the mediumwave band (MF) comprises the frequency range of 300–3000 kHz. The frequency of the sinusoidal long-wave component thus lies in the LF range or lowest decile of the MF range, while the frequency of the microwave component exceeds 1 GHz.

In the shell there are two receivers, on the one hand a receiver 7 which detects the magnetic field $H_{LV}$ of the long-wave signal, with the aid of a loop antenna 8, and a receiver 9 which detects the microwave signal from an antenna 10 situated in the rear of the shell. The two detected signals are applied to a microprocessor system 11 for evaluation.

Figure 2A:
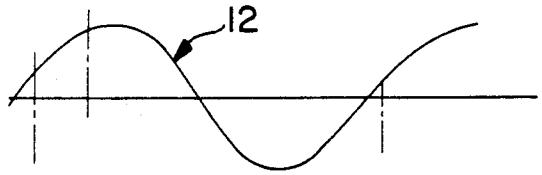
FIGS. 2 and 2*a*–2*d* show the curve shape of the radiation components.
Figure 2B:
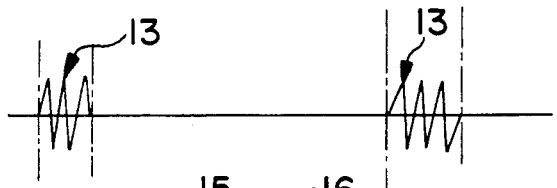

The transmitted long-wave signal 12 has a harmonic sinusoidal form, see FIG. 2*a*. After each zero cross-over with a positive-going derivative, a synchronizing pulse is sent from the long-wave transmitter 2 via the connection 6 to the microwave transmitter 4, which thus initiates transmission of the microwave radiation in the form of a pulse train 13, see FIG. 2*b*.

Figure 2C:
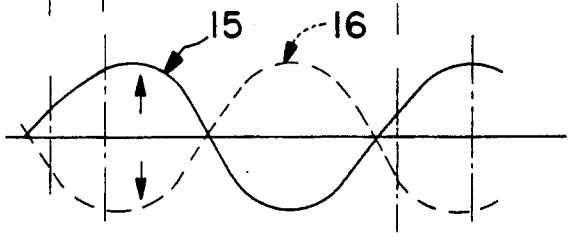

The antenna 8 in the shell for receiving the long-wave radiation is aligned with the aid of a reference point 14 in the shell. When the antenna 8 is oriented parallel to the antenna 3 of the long-wave transmitter, a signal 15 is obtained, and when the shell has turned 180°, a signal 16 is obtained, see FIG. 2*c*.

Figure 2D:
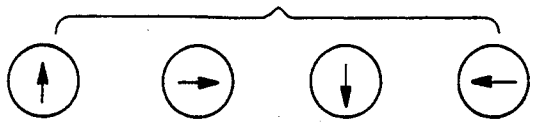
Figure 2:
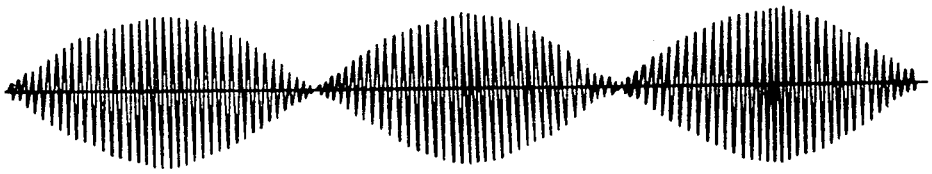

In FIG. 2*d*, the received signal is shown relative to the orientation of the shell. Since the time between the nodes on the rotation envelope corresponds to half a turn of the shell, the microprocessor, knowing the speed of rotation, can calculate in a known manner the actual roll angle position of the shell.

Figure 3:
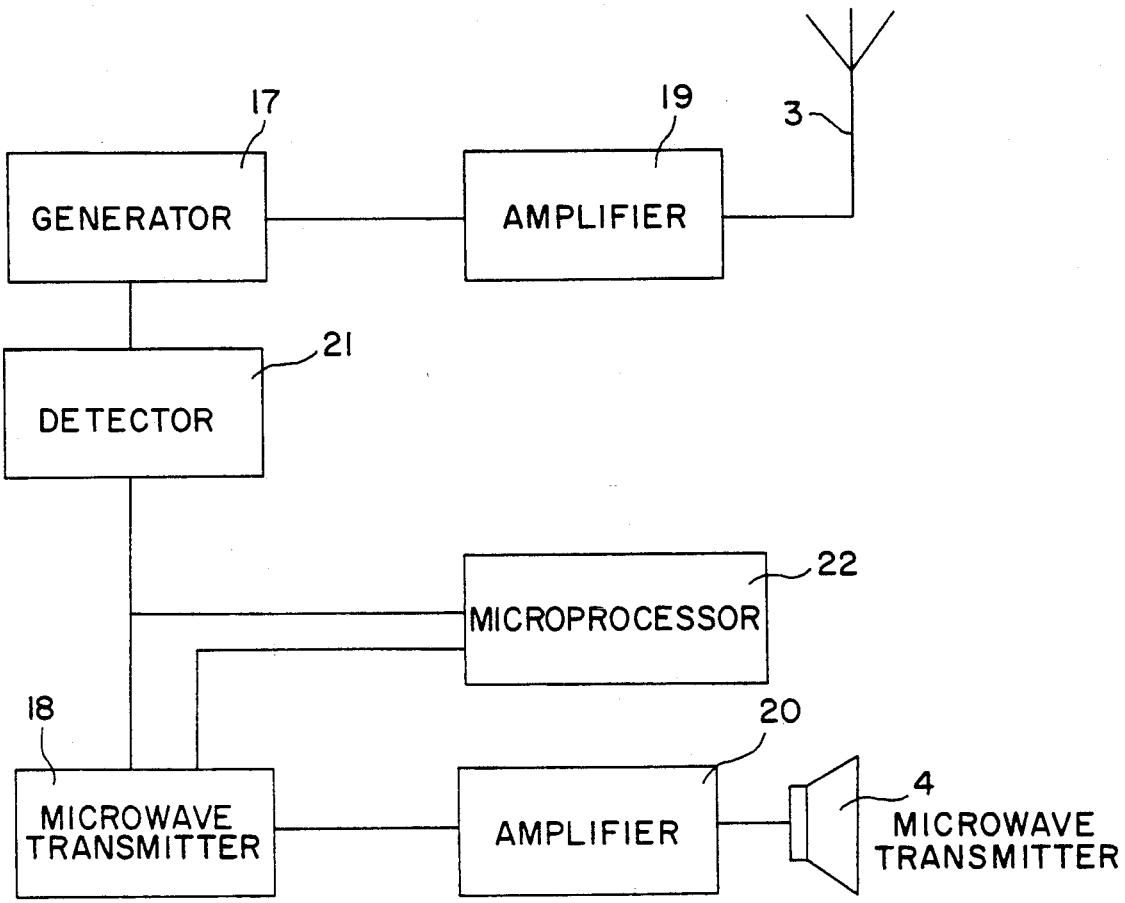
FIG. 3 shows in a block diagram the construction of the transmitter.

In FIG. 3, a block diagram shows how the transmitter is constructed. The transmitter comprises a generator 17 which generates one of the two signals which are required for determining the position, namely the long-wave signal. The other position-determining signal is emitted by the microwave transmitter 18. The signals are amplified in amplifier 19 for the long-wave signal and amplifier 20 for the microwave signal, and the two signals are transmitted by antennae 3 and 4, respectively. An arrangement 21, which detects the derivative and the zero cross-overs of the long-wave signal, gives a signal to a microprocessor 22 and the microwave transmitter 18 when the long-wave signal is situated in the predetermined position. In response to this signal, the microwave transmitter 18 transmits the unique signal which indicates that the long-wave signal is situated in a certain phase position.

Figure 4:
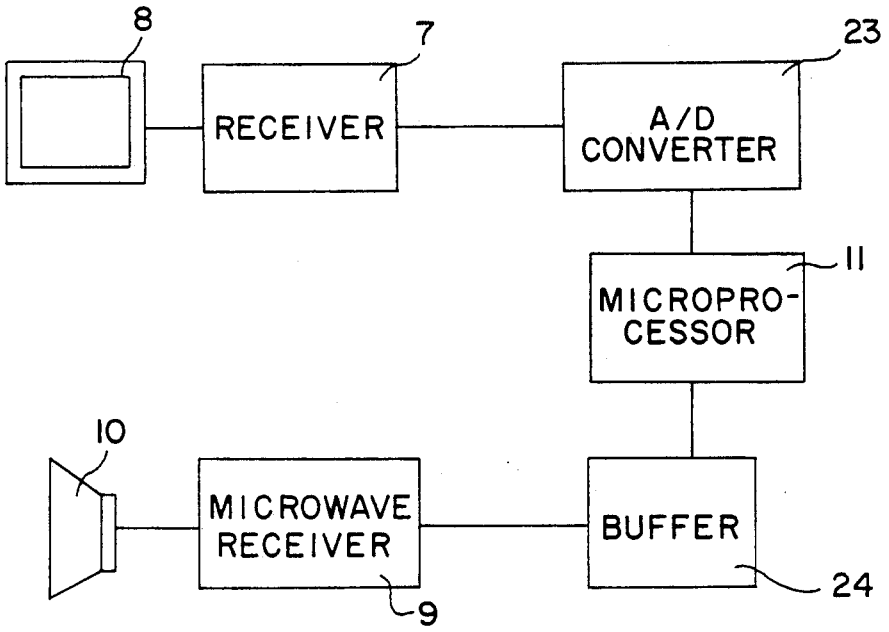
FIG. 4 shows the construction of the receiver.

FIG. 4 shows the construction of the receiver. The receiver comprises two antennae, a long-wave antenna 8 and a microwave antenna 10. The long-wave signal is incoming at a receiver 7 which amplifies the signal to levels which pass through an A/D converter 23. A microprocessor 11 reads the A/D converter and preserves these values in a register. The microwave signal is converted by the microwave receiver 9 to digital signals which are collected in a buffer 24. The main task of the microprocessor is to evaluate the long-wave signal and calculate the actual rotation position starting from earlier data. When information is incoming on the microwave channel, interrupt is requested. If the information contains a derivative indication, the information is updated upwards/downwards, and if it contains a command, the latter is decoded and executed.

As already mentioned, the time between each node in the long-wave signal corresponds to half a turn of the shell. In order to be able to determine unambiguously the actual roll angle position, the speed of rotation must be calculated. This can be calculated with knowledge of the time between the nodes of the rotation envelope. The momentary angle of rotation is calculated such that the time from the latest node gives a value which lies between 0° and 180°. The upward/downward information then gives an offset of 0° (up) or 180° (down). This combination then gives an unambiguous value for the instantaneous angular position.

I claim:

1. An apparatus for determining the roll angle position of a rotating projectile with the aid of polarized electromagnetic radiation, comprising: a transmitter for emitting a position-determining polarized radiation in the direction towards the projectile and a receiver arranged in the projectile for receiving the transmitted radiation, wherein the emitted polarized radiation consists of two components, a first radiation component of a longer wavelength and a second radiation component of a shorter wavelength, the second radiation component comprising a pulse train in which the pulses indicate that the first radiation component is situated in a certain phase position.

2. An apparatus according to claim 1, wherein the first radiation component consists of a sinusoidal long-wave component.

3. An apparatus according to claim 2, wherein the second radiation component consists of a microwave component.

4. An apparatus according to claim 3, wherein the pulses in the microwave component indicate the sinusoidal long-wave component's zero cross-overs with a positive-going derivative, or alternatively with a negative-going derivative.

5. An apparatus according to claim 3, wherein the transmitter comprises a first generator and antenna for transmitting the first radiation component, a second generator and antenna for transmitting the second radiation component, and means for detecting when the first radiation component is situated in a certain position, and emitting a signal to the second generator, the second generator emitting a pulse in order to indicate said position.

6. An apparatus according to claim 5, wherein the first generator includes a long-wave transmitter and the second generator includes a microwave transmitter, and the detecting means detects the long-wave component's zero cross-overs with a positive-going or alternatively negative-going derivative.

7. An apparatus according to claim 5, wherein the receiver in the projectile comprises a first receiver part for receiving the first radiation component and a second receiver part for receiving the second radiation component, and a microprocessor for evaluating the first radiation component.

8. An apparatus according to claim 7, wherein the first receiver part for receiving the first radiation component comprises an antenna which is aligned with the aid of a reference point in the projectile.

* * * * *